US007822222B2

(12) United States Patent
Funahashi

(10) Patent No.: US 7,822,222 B2
(45) **Date of Patent: *Oct. 26, 2010**

(54) LOUDSPEAKER AND METHOD OF MANUFACTURING THE SAME

(75) Inventor: Osamu Funahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 535 days.

This patent is subject to a terminal disclaimer.

(21) Appl. No.: 10/549,771

(22) PCT Filed: Feb. 22, 2005

(86) PCT No.: PCT/JP2005/002750

§ 371 (c)(1),
(2), (4) Date: Sep. 19, 2005

(87) PCT Pub. No.: WO2005/086529

PCT Pub. Date: Sep. 15, 2005

(65) Prior Publication Data

US 2006/0177091 A1 Aug. 10, 2006

(30) Foreign Application Priority Data

Mar. 8, 2004 (JP) ..... 2004-063523

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 7/00*** | (2006.01) |
| ***G10K 13/00*** | (2006.01) |

(52) U.S. Cl. ..... 381/423; 381/403; 181/172; 181/173

(58) Field of Classification Search ..... 381/398, 381/403, 404; 181/170, 172, 173
See application file for complete search history.

(56) References Cited

U.S. PATENT DOCUMENTS

| | | | | |
|---|---|---|---|---|
| 3,125,647 | A * | 3/1964 | Rouy | 381/432 |
| 3,612,783 | A * | 10/1971 | Schneider | 381/404 |
| 3,862,376 | A * | 1/1975 | White | 381/404 |
| 4,029,911 | A * | 6/1977 | Albinger | 381/398 |

(Continued)

FOREIGN PATENT DOCUMENTS

AU 631 866 B2 12/1992

(Continued)

OTHER PUBLICATIONS

International Search Report corresponding to International Appl. No. PCT/JP2005/002750, dated Jun. 7, 2005.

(Continued)

*Primary Examiner*—Curtis Kuntz
*Assistant Examiner*—Jesse A Elbin
(74) *Attorney, Agent, or Firm*—RatnerPrestia

(57) ABSTRACT

A loudspeaker is provided, which has a configuration in which suspension holder extending in a cylindrical shape widening downward is provided on the rear surface of diaphragm so as to be integrated with diaphragm, and the periphery of suspension holder is coupled to frame via second edge. With such a configuration, adhesion work between the suspension holder and the diaphragm as well as heating and drying work of adhesive are not required, thus enabling the productivity to be considerably improved and production equipment and space to be reduced.

8 Claims, 4 Drawing Sheets

U.S. PATENT DOCUMENTS

| | | | | |
|---|---|---|---|---|
| 4,395,597 | A * | 7/1983 | Suzuki et al. | 181/170 |
| 5,056,617 | A * | 10/1991 | Wank et al. | 181/173 |
| 5,734,132 | A * | 3/1998 | Proni | 181/171 |
| 5,793,002 | A * | 8/1998 | Sato et al. | 181/169 |
| 7,209,570 | B2 | 4/2007 | Funahashi et al. | |
| 7,443,996 | B2 | 10/2008 | Funahashi et al. | |
| 2002/0051558 | A1 | 5/2002 | Kuze et al. | |
| 2003/0185415 | A1 * | 10/2003 | Funahashi et al. | 381/398 |
| 2004/0076309 | A1 * | 4/2004 | Sahyoun | 381/412 |
| 2004/0165746 | A1 | 8/2004 | Kreitmeier et al. | |
| 2004/0218778 | A1 | 11/2004 | Weisman | |
| 2009/0022355 | A1 | 1/2009 | Funahashi et al. | |

FOREIGN PATENT DOCUMENTS

| | | | |
|---|---|---|---|
| FR | 2 668 018 | A1 | 4/1992 |
| GB | 2 358 545 | A | 7/2001 |
| JP | 62-051900 | A | 3/1987 |
| JP | 08-102993 | | 4/1996 |
| JP | 09-284890 | | 10/1997 |
| JP | 2000-324592 | | 11/2000 |
| JP | 2001-218295 | | 8/2001 |
| JP | 2002-159091 | | 5/2002 |
| JP | 2004-7331 | | 1/2004 |
| JP | 2004-7331 | A | 1/2004 |
| JP | 2004-007335 | | 1/2004 |

OTHER PUBLICATIONS

English translation of Search Report Form PCT/ISA/210.

English translation of Search Report Form PCT/ISA/210, Jun. 7, 2005.

Supplementary European Search Report for Appl. No. EP 05 71 0482, Nov. 10, 2009.

* cited by examiner

LOUDSPEAKER AND METHOD OF MANUFACTURING THE SAME

This Application is a U.S. National Phase Application of PCT International Application PCT/JP/2005/002750.

TECHNICAL FIELD

The present invention relates to a loudspeaker used for various acoustic equipment and a method for manufacturing the same.

BACKGROUND ART

FIG. 5 is a sectional view showing a configuration of a conventional loudspeaker. In FIG. 5, a magnetic circuit having annular magnetic gap 24 is constructed by combining and bonding magnet 21, plate 22 and yoke 23. Frame 25 is coupled to this magnetic circuit. Voice coil 26 is movably fitted into magnetic gap 24 provided in the magnetic circuit. Diaphragm 27 is adhesively bonded to voice coil 26 at its inner peripheral portion, and to frame 25 at its periphery via roll-shaped first edge 28 that is adhesively bonded to the periphery of diaphragm 27. Suspension holder 29 is adhesively bonded to the middle portion between the inner periphery and outer periphery on the rear side (the side of the magnetic circuit) of diaphragm 27 at its inner peripheral portion, and to frame 25 at its periphery via roll-shaped second edge 30 that is adhesively bonded to the periphery of suspension holder 29. Dust cap 31 is adhesively bonded to the front surface side of diaphragm 27 so as to cover voice coil 26.

In the thus configured conventional loudspeaker, since first edge 28 and second edge 30 were symmetric and similar to each other, harmonic distortion of the speaker was reduced.

Note here that as information of prior art document relating to the invention of this application, for example, Japanese Patent Unexamined Publication No. 2004-7335 is known.

The above-mentioned conventional loudspeaker, however, had the following problems. That is, the conventional loudspeaker was manufactured by the following method. To frame 25 coupled to the magnetic circuit, second edge 30 adhesively bonded to the periphery of suspension holder 29 was attached with adhesive, followed by drying and curing thereof. Thereafter, adhesive was applied to adhesion portion 29*a* and diaphragm 27 was disposed thereon so as to couple the inner peripheral portion of suspension holder 29 to the rear surface of diaphragm 27. The adhesive applied to adhesion portion 29*a* of suspension holder 29 was a heating and drying type adhesive, which needed about 30 minutes of curing time. Therefore, productivity was bad. Furthermore, equipment for heating and drying is large, thus raising the cost of a loudspeaker.

Note here that since the change of such a heating and drying type adhesive to adhesive capable of being cured for a short time may be a factor affecting the property of a loudspeaker, adhesives cannot be changed easily.

SUMMARY OF THE INVENTION

The object of the present invention is to provide a loudspeaker and a method for manufacturing the same capable of improving the productivity and reducing the price by solving the above-mentioned problems with a prior art.

In order to achieve the above-mentioned problems, the present invention provides a speaker comprising a magnetic circuit having an annular magnetic gap, a frame coupled to the magnetic circuit, a voice coil movably fitted into the magnetic gap, and a diaphragm coupled to the frame at its periphery via a first edge, wherein a suspension holder extending downward from a middle portion between an inner periphery and an outer periphery on a rear surface of the diaphragm is integrated with the diaphragm; and the periphery of the suspension holder is coupled to the frame via a second edge that is symmetric and similar to the first edge.

According to such a configuration, adhesion work between the suspension holder and the diaphragm as well as heating and drying work of adhesives are not required, thus enabling the productivity to be considerably improved and production equipment and space to be reduced.

REFERENCE MARKS IN THE DRAWINGS

Figure 1:
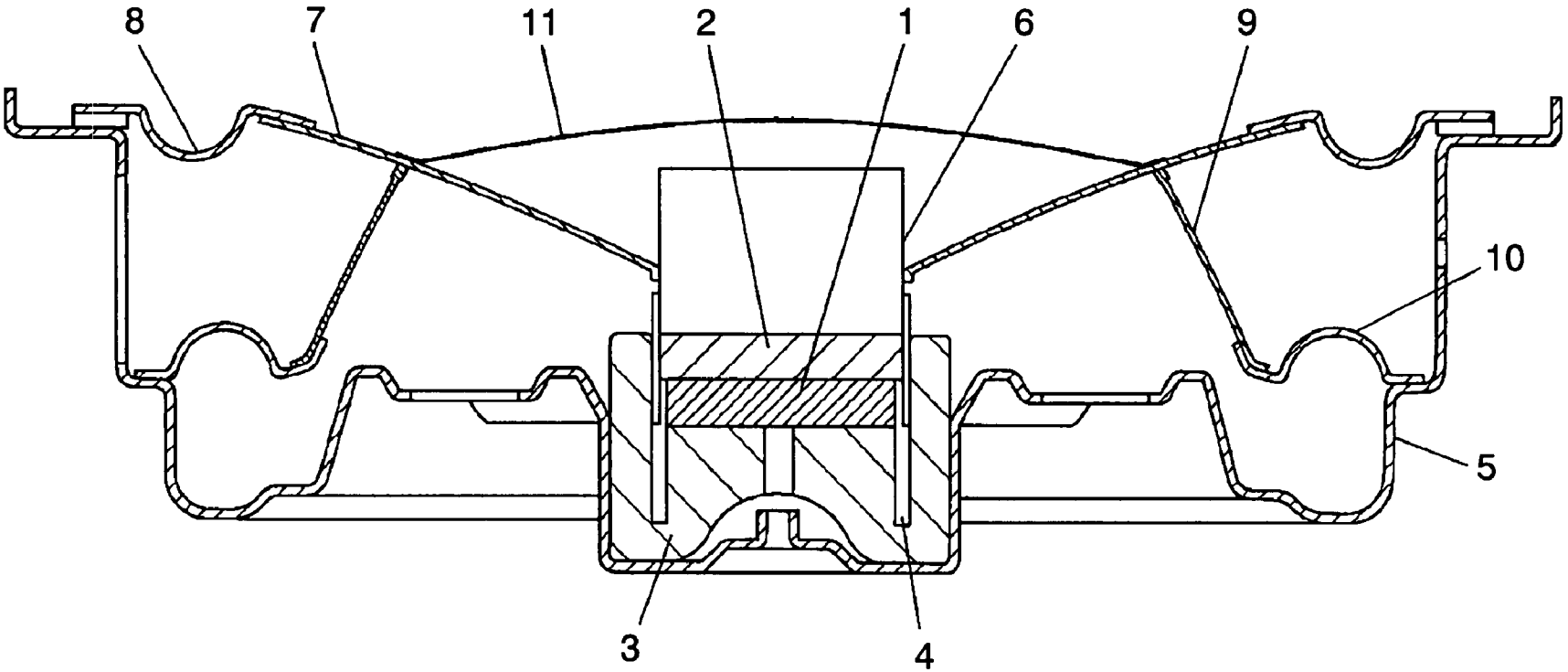
FIG. 1 is a sectional view showing a configuration of a loudspeaker in accordance with a first exemplary embodiment of the present invention.

1 magnet
2 plate
3 yoke
4 magnetic gap
5 frame
6 voice coil
7, 12 diaphragm
8 first edge
9, 13 suspension holder
10 second edge
11 dust cap
12*a* engaging portion

DETAILED DESCRIPTION OF THE PREFERRED EMBODIMENTS

First Exemplary Embodiment

Figure 2:
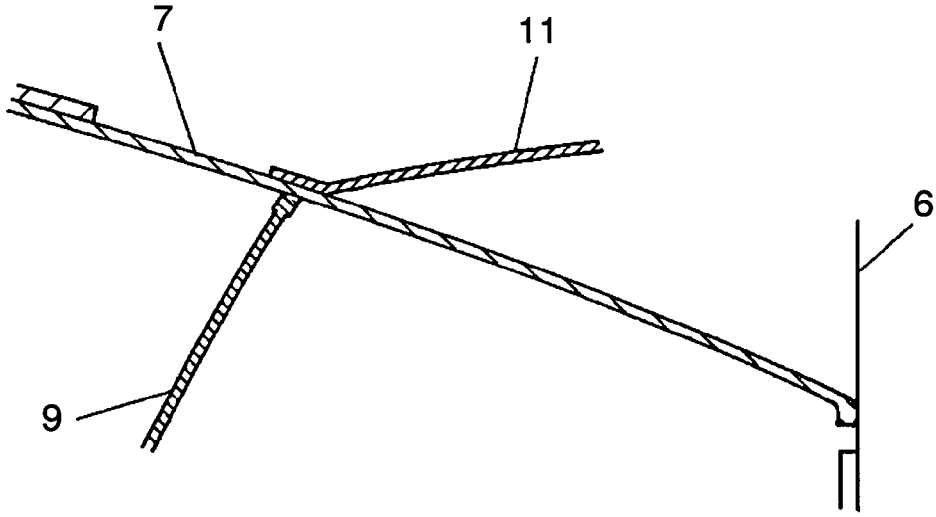
FIG. 2 is a sectional view showing a main portion of the loudspeaker in accordance with the first exemplary embodiment of the present invention.

FIG. 1 is a sectional view showing a configuration of a loudspeaker in accordance with a first exemplary embodiment of the present invention; and FIG. 2 is a sectional view showing a main portion thereof. In FIGS. 1 and 2, a magnetic circuit having annular magnetic gap 4 is constructed by combining and bonding magnet 1, plate 2 and yoke 3. Frame 5 is coupled to the magnetic circuit at its center. Furthermore, voice coil 6 is movably fitted into magnetic gap 4 provided in the magnetic circuit.

Suspension holder 9 is formed in a cylindrical shape on the rear surface side of diaphragm 7 so as to be integrated with diaphragm 7. Diaphragm 7 is adhesively bonded to voice coil 6 at its inner peripheral portion, and to frame 5 at its periphery via roll-shaped first edge 8 that is adhesively bonded to the periphery of diaphragm 7. Furthermore, cylindrical suspension holder 9 is provided extending in a cylindrical shape widening downward from the middle portion between the inner periphery and outer periphery on the rear surface of diaphragm 7, that is, on the side of the magnetic circuit. Furthermore, cylindrical suspension holder 9 is adhesively bonded to frame 5 at it periphery via roll-shaped second edge 10 that is adhesively bonded to the periphery of cylindrical suspension holder 9. Diaphragm 7 integrated with cylindrical suspension holder 9 is formed of resin in order to realize its structure. An example of the preferable resin may include polypropylene resin. Furthermore, dust cap 11 is adhesively bonded to the front surface side of diaphragm 7 so as to cover voice coil 6.

In the thus configured loudspeaker according to the present invention, cylindrical suspension holder 9 disposed on the rear surface of diaphragm 7 extending downward is integrated with diaphragm 7, and the periphery of suspension holder 9 is coupled to frame 5 via second edge 10. Thereby, adhesion work between the suspension holder and the diaphragm as well as heating and drying work of adhesive are not required, thus providing a special effect of enabling the productivity to be considerably improved and production equipment and space to be reduced.

Second Exemplary Embodiment

In the loudspeaker of the first exemplary embodiment, the diaphragm is integrated with the cylindrical suspension holder, whereas in this exemplary embodiment, cylindrical suspension holder and diaphragm are configured as separate parts, and then the cylindrical suspension holder and the diaphragm, which were configured separately, are coupled and thereby integrated with each other. Since other configurations except for this are the same as those in the first exemplary embodiment, the same reference numbers are given to the same parts, and detailed description thereof is omitted. Hereinafter, only the different parts are described in detail with reference to the drawings.

Figure 3:
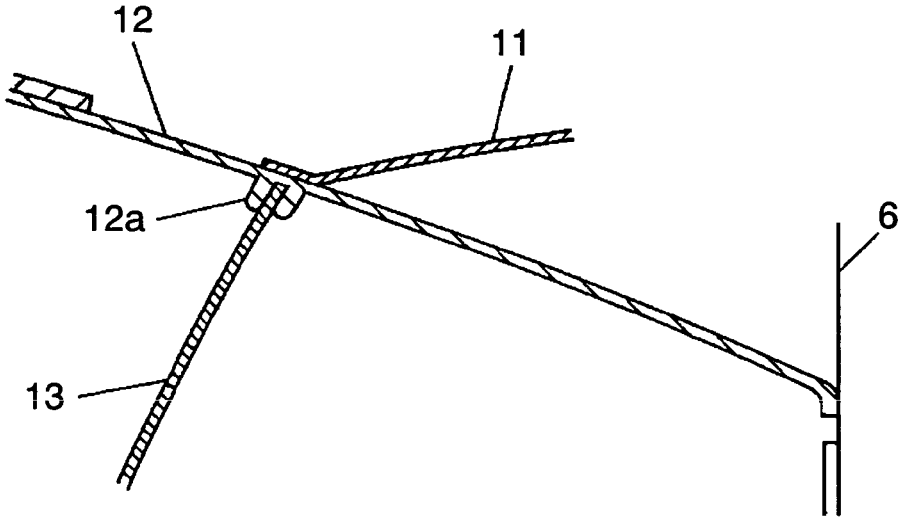
FIG. 3 is a sectional view showing a main portion of a loudspeaker in accordance with a second exemplary embodiment of the present invention.

FIG. 3 is a sectional view showing a main portion of a loudspeaker in accordance with a second exemplary embodiment of the present invention. In FIG. 3, engaging portion 12*a* has a concave shaped cross section and is provided in an annular shape in the middle portion between the inner periphery and the outer periphery on the rear surface of diaphragm 12. Suspension holder 13 is formed in a cylindrical shape widening downward, and the upper side thereof is engaged into the engaging portion 12*a* provided on the rear surface of diaphragm 12 and coupled thereto, and thus suspension holder 13 and diaphragm 12 are integrated with each other.

Furthermore, diaphragm 12 and suspension holder 13 are formed of resin, respectively, and engagement between diaphragm 12 and suspension holder 13 is carried out by welding. An example of the preferable resin to be used may include polypropylene resin.

The loudspeaker configured as in the second exemplary embodiment is manufactured by the following manufacturing method. That is to say, the method for manufacturing the loudspeaker according to the present invention comprises the steps of molding a diaphragm and a suspension holder with resin separately, coupling the molded diaphragm and the molded suspension holder so as to be integrated with each other, and integrating the resin-molded diaphragm and the resin-molded suspension holder with each other by welding.

In the loudspeaker manufactured by the above-mentioned manufacturing method of the second exemplary embodiment, cylindrical suspension holder 13 and diaphragm 12 are configured as separate parts. Thereby, as compared with the diaphragm that is integrated with the cylindrical suspension holder in the loudspeaker of the first exemplary embodiment, a configuration of a molding die can be simplified to thus improve the molding property. Furthermore, by engaging suspension holder 13 into engaging portion 12*a* provided on the rear surface of diaphragm 12, accurate positioning can be carried out. Therefore, the same effect as that in the first exemplary embodiment can be obtained without problems in the dimensional accuracy.

Note here that in the second exemplary embodiment, the case in which diaphragm 12 and suspension holder 13 are coupled to each other by thermal welding was described. However, the present invention is not limited thereto. In addition to welding using heat etc., coupling with adhesive or mechanically coupling and further combination thereof may be employed.

Furthermore, in the second exemplary embodiment, a configuration in which diaphragm 12 is provided with engaging portion 12*a* into which suspension holder 13 is engaged was described as an example. However, the present invention is not limited thereto, and an engaging portion may be also provided on suspension holder 13 so that both are engaged with each other.

Third Exemplary Embodiment

In this exemplary embodiment, the directions of the rolls of the first edge and the second edge are allowed to be different from those in the loudspeaker according to the first exemplary embodiment. Since configurations except for this are the same as those in the first exemplary embodiment, the same reference numbers are given to the same parts, and detailed description thereof is omitted. Hereinafter, only the different parts are described with reference to the drawings.

Figure 4:
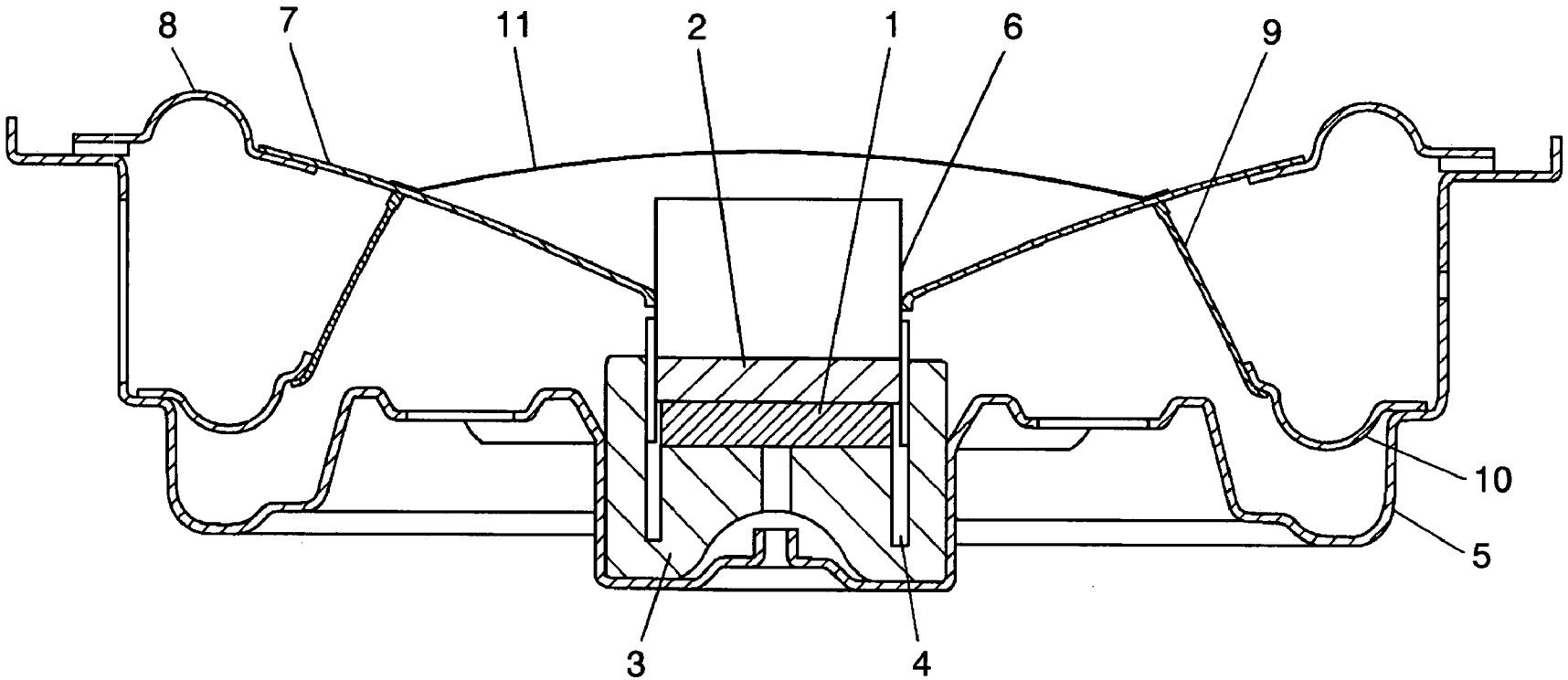
FIG. 4 is a sectional view showing a configuration of a loudspeaker in accordance with a third exemplary embodiment of the present invention.
Figure 5:
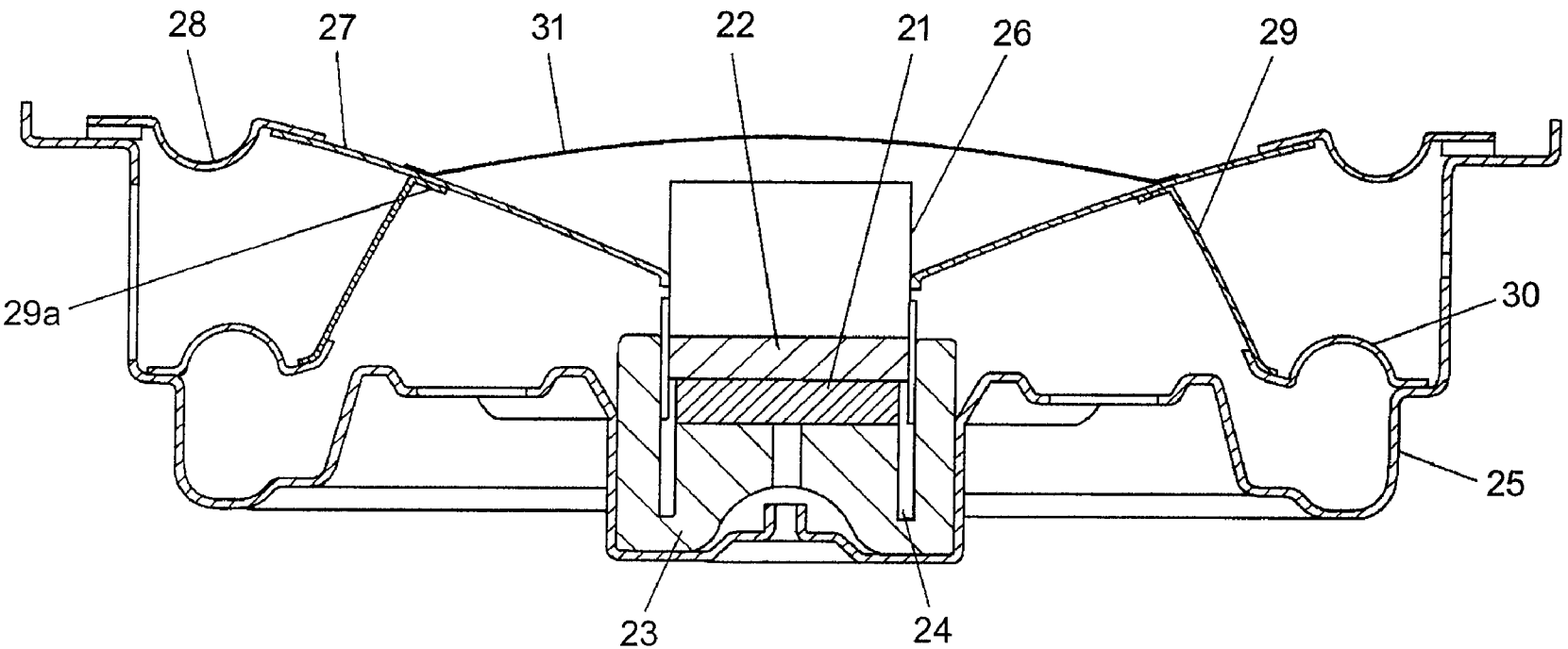
FIG. 5 PRIOR ART
FIG. 5 is a sectional view showing a configuration of a conventional loudspeaker.

FIG. 4 is a sectional view showing a configuration of a loudspeaker in accordance with a third exemplary embodiment of the present invention. In FIG. 4, first edge 8 is adhesively bonded to the periphery of diaphragm 7, and second edge 10 is adhesively bonded to the periphery of suspension holder 9. First edge 8 and second edge 10 nave semicircular roll shape, respectively, and they are symmetric and similar to each other. This configuration is the same as that in the first exemplary embodiment. However, in the third exemplary embodiment, the roll of first edge 8 extends upward and the roll of second edge 10 extends downward.

With such a configuration, since the above-mentioned roll portions are away from or close to each other, traces accompanied by the amplitude of the edges are equivalently increased so as to increase the rigidity. Thus, the rolling phenomenon of voice coil 6 is further suppressed.

INDUSTRIAL APPLICABILITY

In the loudspeaker according to the present invention, since a suspension holder and a diaphragm are integrated with each other, a drying step of a heating and drying type adhesive is not required. Thus, the speaker of the present invention has an effect of enabling the productivity to be considerably improved and production equipment and space to be reduced. In particular, the loudspeaker of the present invention is useful to loudspeakers for automobile use.

The invention claimed is:

1. A loudspeaker comprising:

a magnetic circuit having an annular magnetic gap;

a frame coupled to the magnetic circuit;

a voice coil movably fitted into the magnetic gap;

a diaphragm coupled to the frame at its periphery via a first edge, the diaphragm including an engaging portion integrally formed with the diaphragm, the engaging portion extending in a substantially perpendicular direction from a rear surface of the diaphragm; and a suspension holder extending downward from a middle portion between an inner periphery and an outer periphery on the rear surface of the diaphragm, the suspension holder being integrated with the diaphragm via a coupling portion which engages the engaging portion, wherein the periphery of the suspension holder is coupled to the frame via a second edge that is symmetric and similar to the first edge.

2. The loudspeaker according to claim 1, wherein the diaphragm is formed of resin.

3. The loudspeaker according to claim 1, wherein the first edge and the second edge are formed in a semicircular roll shape, respectively, and the roll of the first edge extends downward and the roll of the second edge extends upward.

4. The loudspeaker according to claim 1, wherein the first edge and the second edge are formed in a semicircular roll shape, respectively, and the roll of the first edge extends upward and the roll of the second edge extends downward.

5. The loudspeaker according to claim 1, wherein the suspension holder and the diaphragm are formed of a resin.

6. The loudspeaker according to claim 5, wherein the resin is polypropylene resin.

7. The loudspeaker according to claim 1, wherein the engaging portion comprises a pair of annular projections extending from the rear surface of the diaphragm, the pair of annular projections defining an annular gap, the coupling portion of the suspension holder being positioned within the annular gap.

8. A method for manufacturing a loudspeaker comprising a magnetic circuit having an annular magnetic gap; a frame coupled to the magnetic circuit; a voice coil movably fitted into the magnetic gap; and a diaphragm having an engaging portion, wherein a suspension holder extending downward from a middle portion between an inner periphery and an outer periphery on a rear surface of the diaphragm is integrated with the diaphragm via a coupling portion which engages the engaging portion, the method comprising the steps of:

integrally molding the diaphragm and the engaging portion such that the engaging portion extends in a substantially perpendicular direction from the rear surface of the diaphragm;

molding the suspension holder with resin;

coupling the coupling portion of the molded suspension holder to the engaging portion of the molded diaphragm;

coupling the molded diaphragm to the frame at its periphery via a first edge; and coupling the molded suspension holder to the frame via a second edge that is symmetric and similar to the first edge.

* * * * *

UNITED STATES PATENT AND TRADEMARK OFFICE

CERTIFICATE OF CORRECTION

PATENT NO. : 7,822,222 B2
APPLICATION NO. : 10/549771
DATED : October 26, 2010
INVENTOR(S) : Osamu Funahashi It is certified that error appears in the above-identified patent and that said Letters Patent is hereby corrected as shown below:

On Page 2, FIELD [56], References Cited, FOREIGN PATENT DOCUMENTS, duplicate reference "JP 2004-7331 A 1/2004" should be deleted.

Signed and Sealed this
Fifth Day of April, 2011

David J. Kappos

David J. Kappos
*Director of the United States Patent and Trademark Office*